US011952773B2

(12) United States Patent
Gosling et al.

(10) Patent No.: US 11,952,773 B2
(45) Date of Patent: Apr. 9, 2024

(54) MODULAR WALL SYSTEM HAVING THIN WALLS

(71) Applicant: DIRTT ENVIRONMENTAL SOLUTIONS LTD., Calgary (CA)

(72) Inventors: Geoff W. Gosling, Calgary (CA); Thomas A. Brown, Calgary (CA); Colin V. Blehm, Calgary (CA); Taylor W. Merchant, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 215 days.

(21) Appl. No.: 17/312,896

(22) PCT Filed: Feb. 21, 2020

(86) PCT No.: PCT/US2020/019240

§ 371 (c)(1),
(2) Date: Jun. 10, 2021

(87) PCT Pub. No.: WO2020/172542

PCT Pub. Date: Aug. 27, 2020

(65) Prior Publication Data

US 2022/0056688 A1 Feb. 24, 2022

Related U.S. Application Data

(60) Provisional application No. 62/809,306, filed on Feb. 22, 2019.

(51) Int. Cl.
*E04B 2/74* (2006.01)

(52) U.S. Cl.
CPC .... *E04B 2/7453* (2013.01); *E04B 2002/7461* (2013.01)

(58) Field of Classification Search
CPC ..... E04B 2/7453; E04B 2002/7461; E04B 2002/7462; E04B 1/6162; E04B 2/7836; E04B 2002/7492
See application file for complete search history.

(56) References Cited

U.S. PATENT DOCUMENTS 2,962,133 A * 11/1960 Kivett ..... F16B 5/0072 52/471
5,125,201 A 6/1992 Pieters
5,592,794 A * 1/1997 Tundaun ..... E04B 1/6162 52/582.1

FOREIGN PATENT DOCUMENTS

FR 2112959 6/1972
WO 2004/083545 9/2004

OTHER PUBLICATIONS

International Preliminary Report on Patentability received for PCT Patent Application No. PCT/US2020/019240, dated Sep. 2, 2021, 14 pages.

(Continued)

*Primary Examiner* — Patrick J Maestri
(74) *Attorney, Agent, or Firm* — Workman Nydegger

(57) ABSTRACT

A pre-fabricated wall system can include a first thin wall module and a second thin wall module. The two thin wall modules have a depth defined by a distance from a front surface of each thin wall module to aback surface of each thin wall module. The pre-fabricated wall system can further include a vertical connection post that has a first connection interface on a first side configured to secure to the first thin wall module. The first connection interface can include a first channel. The vertical connection post can also include a second connection interface on a second side opposite the first side configured to secure to the second thin wall module. The second connection interface can include a second channel. The two thin wall modules can be parallel (Continued)

or co-planar to one another when the two thin wall modules are secured to the vertical connection post.

17 Claims, 6 Drawing Sheets

(56) References Cited

OTHER PUBLICATIONS

International Search Report and Written Opinion received for PCT Patent Application No. PCT/US2020/019240, dated Aug. 7, 2020, 17 pages.
Invitation to Pay Additional Fees received for PCT Patent Application No. PCT/US2020/019240, dated Jun. 17, 2020, 13 pages.

* cited by examiner

MODULAR WALL SYSTEM HAVING THIN WALLS

CROSS-REFERENCE TO RELATED APPLICATIONS

This application is a 371 US nationalization of PCT Patent Application No. PCT/US2020/019240, filed Feb. 21, 2020, which claims priority to U.S. provisional patent application No. 62/809,306, filed Feb. 22, 2019. The entire content of the aforementioned patent applications is incorporated herein by reference.

BACKGROUND

Technical Field

The present invention relates generally to systems, methods, and apparatus for forming, assembling, and installing modular wall systems. More specifically, the present invention relates to connection apparatus for modular wall systems comprising thin wall modules.

Background and Relevant Art

Office space can be relatively expensive, not only due to the basic costs of the location and size of the office space, but also due to any construction needed to configure the office space in a particular way. Furthermore, as an organization's needs change, the organization may need to have a convenient and efficient means to reconfigure the existing office space rather than having to move to a new office space. Many organizations address their configuration and reconfiguration issues by dividing large, open office spaces into individual work areas using pre-fabricated wall systems.

Pre-fabricated wall systems, including modular wall systems, are relatively easy to configure and/or reconfigure and can be less expensive to set up than more permanently constructed office dividers. Manufacturers or designers typically design such pre-fabricated walls and partitions to include a series of individual wall sections or modules (often including one or more wall tiles that are surrounded by vertical and horizontal end frames) that can be assembled together to form a range of different configurations. These wall modules/sections are usually connected to one or more structural components that form a frame-type structure of the pre-fabricated wall.

The individual wall modules that make up pre-fabricated wall systems are typically relatively thick. For example, pre-fabricated wall modules are often four inches thick or greater. Pre-fabricated wall modules often need to be thick and/or include structural features to enable pre-fabricated wall systems to provide sufficient support against lateral forces that may be applied to installed pre-fabricated wall systems. In this regard, pre-fabricated wall systems often employ thick wall modules in order to comply with building codes for interior construction.

However, pre-fabricated wall system users often desire, for aesthetic or other purposes, to divide interior spaces with wall modules that are relatively thin. For example, pre-fabricated wall system users often desire to implement pre-fabricated wall modules/sections that include only a single thin wall tile (or vertical arrangement of thin wall tiles) surrounded by horizontal and vertical end frames. Thin wall tiles can be, for example, one inch in thickness or less and constructed of a solid sheet of rigid material, such as glass. To provide a sleek aesthetic, users often desire the horizontal and vertical end frames that house one or more thin wall tiles to also be thin in order to avoid a large disparity between the thickness of the end frames and the thickness of the wall tile surrounded by the end frames.

However, the need to provide pre-fabricated wall systems that can sufficiently withstand lateral forces can constrain the thinness of pre-fabricated wall modules. For instance, manufacturers and designers have difficulty creating pre-fabricated wall modules that are thin enough to present a thin wall tile in an aesthetically pleasing manner while still providing sufficient support for pre-fabricated wall systems against lateral forces.

In addition to aesthetics, many pre-fabricated wall system users often desire thin wall modules for functional purposes. For example, thicker pre-fabricated wall modules can include an interior space for housing electrical wiring or other utility lines (e.g., vacuum lines, gas lines, and/or other fluid lines in dental and/or medical environments). However, some installation spaces include more utility lines than can fit within interior spaces of conventional pre-fabricated wall modules. Users, therefore, often install pre-fabricated wall modules offset from building walls to form a space between the pre-fabricated wall modules and the building walls that is large enough to house numerous utility lines. In such instances, users often desire for pre-fabricated wall modules to be as thin as possible to save interior space (e.g., to prevent thick pre-fabricated wall modules from unnecessarily taking up installation space).

Accordingly, there are a number of problems in the field of pre-fabricated wall systems that can be addressed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Implementations of the present invention extend to systems, methods, and apparatus for forming, assembling, and installing pre-fabricated wall systems. More specifically, the present invention relates to connection apparatus for pre-fabricated wall systems comprising thin wall modules. For example, at least one embodiment comprises two thin wall modules and a vertical connection post with channeled connection interfaces for affixing to both of the thin wall modules. At least another embodiment includes a pre-fabricated wall tile and a vertical end frame that has opposing channels that share a channel wall, with one of the channels being configured to align with a channel of another vertical end frame to facilitate connection thereto. The embodiments disclosed and claimed herein provide pre-fabricated wall systems that can implement thin vertical end frames to provide thin wall modules that reduce the spatial occupancy of pre-fabricated wall systems and provide a thin, sleek aesthetic appearance while still providing sufficient support against lateral forces that can be applied to pre-fabricated wall systems.

For example, a pre-fabricated wall system configured for a thin wall module configuration can include a first thin wall module and a second thin wall module. The two thin wall modules have a depth defined by a distance from a front surface of each thin wall module to a back surface of each thin wall module. The pre-fabricated wall system can further include a vertical connection post that has a first connection interface on a first side configured to secure to the first thin wall module. The first connection interface can include a first channel. The vertical connection post can also include a second connection interface on a second side opposite the first side configured to secure to the second thin wall module. The second connection interface can include a second channel. The two thin wall modules can be parallel or co-planar to one another when the two thin wall modules are secured to the vertical connection post.

In addition, a pre-fabricated wall system configured for a thin wall module configuration can include two wall modules, including a first wall module and a second wall module. The first and second wall modules can have a depth defined by a distance from a front surface of each wall module to a back surface of each wall module. The pre-fabricated wall system can further include a first vertical end frame attached to a vertical edge of the first wall module and a second vertical end frame attached to a vertical edge of the second wall module. Each of the first and second vertical end frames can include a channel. The pre-fabricated wall system can further include a vertical connection post that has a first connection interface on a first side configured to secure to the first wall module. The first connection interface can include a first channel. The vertical connection post can further include a second connection interface on a second side opposite the first side configured to secure to the second wall module. The second connection interface can include a second channel. The pre-fabricated wall system can further include first and second channel inserts. The first channel insert can be configured to reside within the first channel of the first connection interface and the channel of the first vertical end frame of the first wall module to secure the first wall module to the vertical connection post. The second channel insert is configured to reside within the second channel of the second connection interface and the channel of the second vertical end frame of the second wall module to secure the second wall module to the vertical connection post. The first and second wall modules are arranged non-parallel to one another when the first and second wall modules are secured to the vertical connection post.

Furthermore, a pre-fabricated wall module configured for a thin pre-fabricated wall configuration can include a pre-fabricated wall tile and a vertical end frame connected to a vertical edge of the pre-fabricated wall tile. The vertical end frame can include a first channel configured for receiving the vertical edge of the pre-fabricated wall tile and a second channel disposed opposite the first channel. The second channel can include a shared channel wall that is shared between the first channel and the second channel, a second channel opening that faces a direction that is opposite to a first channel opening of the first channel, channel protrusions extending in opposite directions from the second channel opening, and anchoring channels disposed on opposing channel sidewalls of the second channel.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
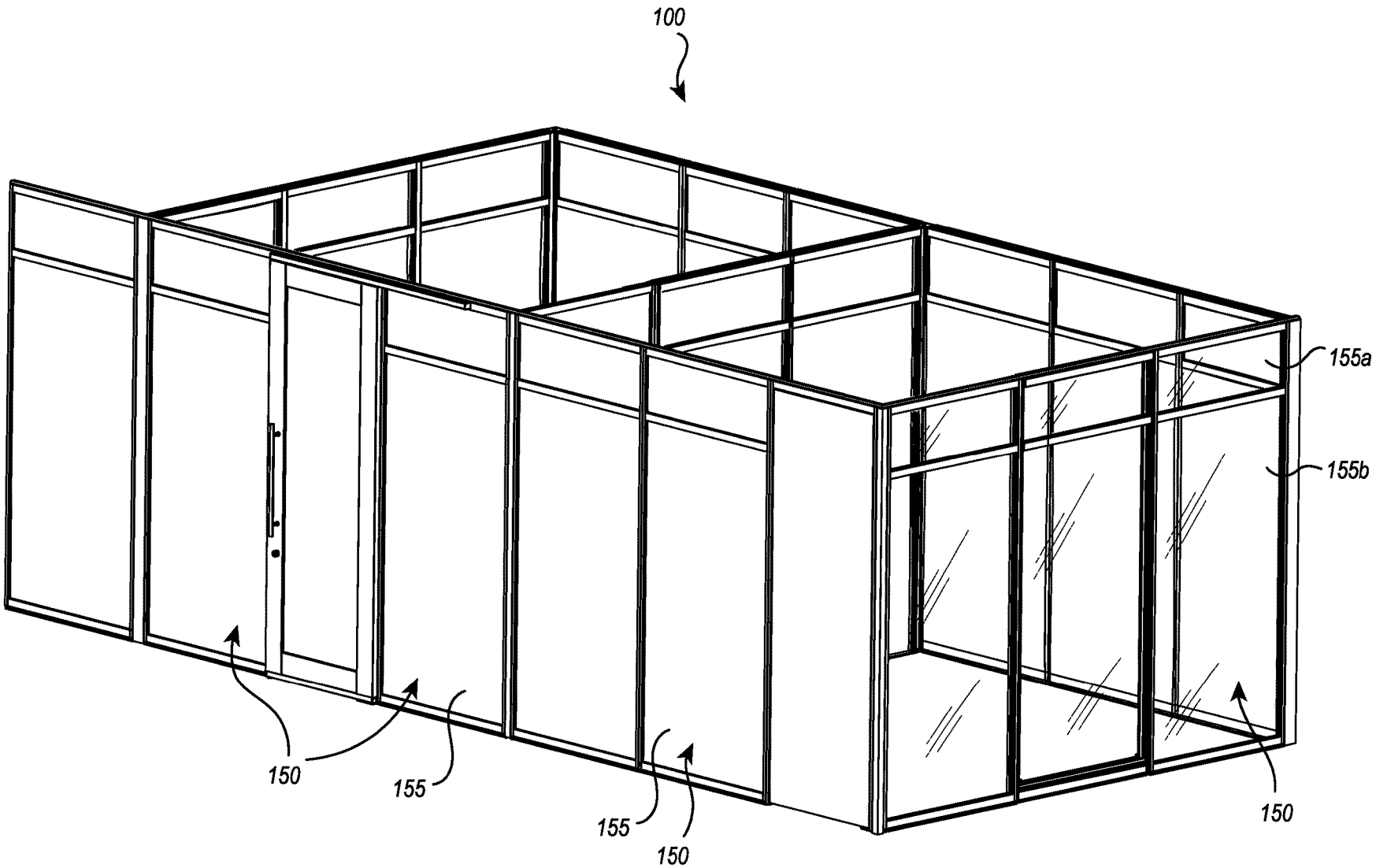
FIG. 1 illustrates a perspective view of a pre-fabricated wall system including thin wall modules, in accordance with implementations of the present disclosure.

Implementations of the present invention extend to systems, methods, and apparatus for forming, assembling, and/or installing pre-fabricated wall systems. More specifically, the present invention relates to pre-fabricated wall systems configured for thin wall module configurations. For example, in one implementation of the present disclosure, a pre-fabricated wall system configured for a thin wall module configuration can include two wall modules, including a first wall module and a second wall module. The first and second wall modules can have a depth defined by a distance from a front surface of each wall module to a back surface of each wall module.

The pre-fabricated wall system can further include a first vertical end frame attached to a vertical edge of the first wall module and a second vertical end frame attached to a vertical edge of the second wall module. Each of the first and second vertical end frames can include a channel. The pre-fabricated wall system can further include a vertical connection post that has a first connection interface on a first side configured to secure to the first wall module. The first connection interface can include a first channel. The vertical connection post can further include a second connection interface on a second side opposite the first side configured to secure to the second wall module. The second connection interface can include a second channel. The pre-fabricated wall system can further include first and second channel inserts.

The first channel insert can be configured to reside within the first channel of the first connection interface and the channel of the first vertical end frame of the first wall module to secure the first wall module to the vertical connection post. The second channel insert is configured to reside within the second channel of the second connection interface and the channel of the second vertical end frame of the second wall module to secure the second wall module to the vertical connection post. The first and second wall modules can be arranged parallel, co-planar, or non-parallel to one another when the first and second wall modules are secured to the vertical connection post.

In at least another embodiment, a pre-fabricated wall module configured for a thin pre-fabricated wall configuration can include a pre-fabricated wall tile and a vertical end frame connected to a vertical edge of the pre-fabricated wall tile. The vertical end frame can include a first channel configured for receiving the vertical edge of the pre-fabricated wall tile and a second channel disposed opposite the first channel. The second channel can include a shared channel wall that is shared between the first channel and the second channel, a second channel opening that faces a direction that is opposite to a first channel opening of the first channel, channel protrusions extending in opposite directions from the second channel opening, and anchoring channels disposed on opposing channel sidewalls of the second channel.

One aspect of at least some of the disclosed embodiments is to provide thin wall modules with thin end frames that may house a single thin wall tile (or a vertical arrangement of thin wall tiles) and that are configurable to join with other thin wall modules (e.g., via a vertical connection post 300, see FIG. 4, or directly, see FIG. 5) within a pre-fabricated wall system. Pre-fabricated wall systems that allow for thin wall modules to house thin pre-fabricated wall tiles (e.g., wall tiles that are one inch or less in thickness) may avoid the aforementioned disparity in thickness between thin wall tiles and end frames that house the thin wall tiles. For example, the thin end frames of the thin wall modules that house thin wall tiles may have a thickness within a range of 1.5 inches to 2.75 inches.

Another aspect of at least some of the disclosed embodiments is to provide thin wall modules that can occupy less installation space than conventional pre-fabricated wall modules. Additionally, at least some of the presently disclosed thin pre-fabricated wall modules may save on materials and/or provide a pleasing, sleek aesthetic.

FIG. 1 illustrates a perspective view of an example of a pre-fabricated wall system 100 that includes thin wall modules 150. As used herein, the term "module" or "wall module" (e.g., 110, 150) refers to a definable section of a pre-fabricated wall comprising at least one vertical frame (e.g., 250) and at least one horizontal frame/connection component (e.g., 205). In some cases, the module may refer to a section comprising at least two vertical frames jointed by at least two horizontal frames, as well as an attached at least one front tile/panel (or divider) (e.g., 155) and/or at least one rearward tile/panel (or divider) (e.g., 155). Accordingly, a modular or pre-fabricated wall system means a set of vertical and horizontal frames that may be prepared to specifications and frequently at least partly assembled offsite and assembled together onsite as a modular or pre-fabricated wall/wall system. The horizontal and vertical frame components, in turn, can comprise any number or composition of structurally suitable materials, including but not limited to aluminum, steel, iron, copper, resin, rubber, or composites thereof.

FIG. 1 shows that at least some of the thin wall modules 150 can be arranged adjacent to other thin wall modules 150 in parallel with one another. FIG. 1 also shows that at least some of the thin wall modules 150 can be arranged perpendicular to other thin wall modules 150. According to the present disclosure, thin wall modules 150 may be joined to other thin wall modules 150 via a direct connection between the thin wall modules 150 (see, for example FIG. 5) and/or via an intervening vertical connection post (see, for example, FIGS. 4 and 5).

FIG. 1 illustrates that at least some of the thin wall modules 150 include thin wall tiles 155 that are surrounded/secured by frame components. The implementations illustrated in FIG. 1 show that the thin wall tiles 155 of the thin wall modules 150 can be surrounded by end frames that enable the thin wall modules 150 to interface with and/or secure to other adjacent wall modules and/or structural components (e.g., vertical connection posts 300, see FIGS. 3A-3D).

FIG. 1 furthermore illustrates that wall tiles of the wall modules of the pre-fabricated wall system 100 may be disposed above or below one another. For instance, thin wall tiles 155*a* and 155*b* are vertically arranged to form a modular thin wall module 150 that includes adjacently arranged thin wall tiles 155*a* and 155*b*. The vertically arranged wall tiles 155*a* and 155*b* may be separated by a horizontal connection component (e.g., horizontal connection component 205, see FIG. 2A).

The thickness of a wall module, as used herein, may be defined as the distance between front and back faces of the wall module. However, one will recognize, in view of the present disclosure, that the front and/or back faces of a wall module may have different meanings, depending on the configuration of the wall module. For instance, the front and back faces of a wall module that includes multiple, opposing wall tiles arranged on frame components may be defined as the outward-facing surfaces of the opposing wall tiles of the wall module. Accordingly, the thickness of such a wall module may be defined as the distance between the outward-facing surfaces of the opposing wall tiles of the wall module.

In other instances, the front and back faces of a wall module that includes only a single wall tile secured by surrounding end frames (e.g., the thin wall modules 150 shown in FIG. 1) may be defined as the outward-facing portions/surfaces of the end frames themselves. Accordingly, the thickness of such a wall module may be defined as the thickness of the end frames that surround the single wall tile. In some embodiments, thin wall modules 150 have a thickness that is less than or equal to 2.75 inches (e.g., within a range of 1.5 inches to 2.75 inches).

Put differently, the thickness of a wall module, as used herein, may be defined as the distance between the opposing outmost faces of the wall module, whether the opposing outmost faces be surfaces of opposing wall tiles or opposing surfaces of end frames.

The wall tiles 155 illustrated in FIG. 1 may be composed of numerous materials, such as solid glass, plastics/polymers, metals (e.g., sheet metals), wood/paper products, composites, fabrics (e.g., as a facing/finishing/barrier material) and/or any other suitable material or combination thereof.

Figure 2A:
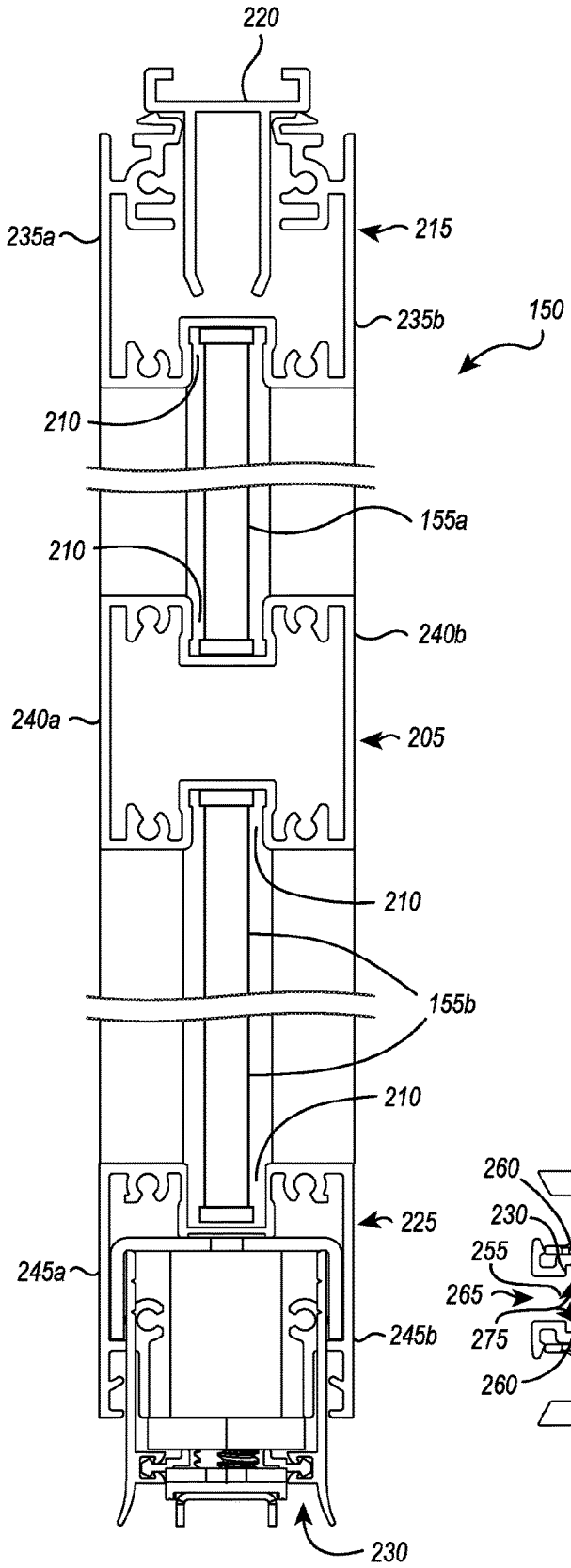
FIG. 2A illustrates a side sectioned view of components of a thin wall module, in accordance with implementations of the present disclosure.
Figure 2B:
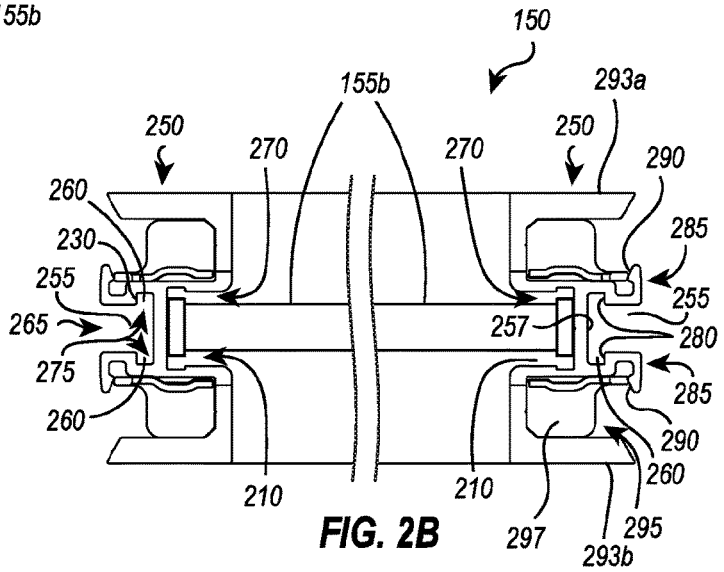
FIG. 2B illustrates a top sectioned view of components of a thin wall module, in accordance with implementations of the present disclosure.

FIGS. 2A and 2B illustrate additional details concerning the thin wall modules 150 that include thin wall tiles 155 surrounded by end frames. One will recognize, however, that thin wall modules may alternatively include front and back wall tiles affixed to frame components and surrounded by end frames.

FIGS. 2A and 2B illustrate, respectively, side and top sectional views of components of thin wall modules 150. In particular, FIG. 2A illustrates a side sectional view of a thin wall module 150 having a top thin wall tile 155*a* and a bottom thin wall tile 155*b*. As mentioned above, a horizontal connection component 205 may connect to both the top thin wall tile 155*a* and the bottom thin wall tile 155*b*. The horizontal connection component 205 illustrated in FIG. 2A includes channels 210 on opposing sides thereof for securing the thin wall tiles 155*a*, 155*b* (with friction fitting or other securing elements known in the art).

The wall module 150 shown in FIG. 2A also includes a ceiling interface component 215 and a floor interface component 225. FIG. 2A further shows that the ceiling interface component 215 and the floor interface component 225 can include channels 210 for securing to the thin wall tiles 155*a*, 155*b*. In particular, the channel 210 of the ceiling interface component 215 secures a top edge of the top thin wall tile 155*a*, and the channel 210 of the floor interface component 225 secures a bottom edge of the bottom thin wall tile 155*b*.

The ceiling interface component 215 extends along a top of the thin wall module 150 and may operate to secure the thin wall module 150 to a ceiling. For example, FIG. 2A shows that the ceiling interface component 215 accommodates an upper channel 220 for interfacing with a ceiling attachment clip or other attachment mechanism installed on a ceiling. Similarly, the floor interface component 225 extends along a bottom of the thin wall module 150 and may operate to secure the wall module to a floor. For instance, FIG. 2A shows that floor interface component 225 includes an adapting surface 230 for attaching to floor connection elements, such as attachment clips, carpet grippers, wall levelers, wall to floor flexible trim, and/or any attachment mechanisms known in the art.

FIG. 2B illustrates a top sectional view of the thin wall module 150 that shows thin wall tile 155*b* secured to and positioned between two vertical end frames 250. Similar to the ceiling interface component 215 and the floor interface component 225 shown in FIG. 2A, the vertical end frames 250 also include channels 210 for securing/connecting to opposing vertical edges/ends of the thin wall tile 155*b*. The vertical end frames 250 also include channels 255. The channels 255 are configured to align with corresponding channels of vertical connection posts of a pre-fabricated wall system (e.g., vertical connection post 300, see FIGS. 3A-3D) or with channels 255 of another vertical end frame of another thin wall module (e.g., an adjacently arranged thin wall module).

FIG. 2B shows that the channels 255 share a shared channel wall 257 with the channels 210. In particular, each channel 255 is disposed opposite to each channel 210 with channel openings 265 and 270 facing in opposite directions. One side of each shared channel wall 257 acts as channel wall for the channels 255 while an opposing side of each shared channel wall 257 acts as a channel wall for the channels 210.

As illustrated, the shared channel wall 257 of the channels 255 and 210 is thinner than the channel depth of the channels 255, 210 (e.g., the distance between the channel openings 265, 270 and the shared channel wall 257). In some instances, the shared channel wall 257 of the channels 255, 210 allows the structural supporting features of the vertical end frames 250 to be configured in a space-efficient manner, allowing the thickness and the width of the end frames 250 (and, consequently, the thin wall module 150) to be thinner than otherwise. The arrangement of the channels 255, 210 with a shared channel wall may also allow the thin wall modules 150 to be constructed in a manner that saves on the cost of materials, especially because the vertical end frames 250 may be constructed in a space-efficient manner.

The channels 255 also include anchoring channels 260 disposed within the interior of the channels 255. The anchoring channels shown in FIG. 2B are configured to receive anchor extensions 480 of a channel insert 475 (see, for example, FIG. 4).

FIG. 2B shows that the anchoring channels 260 can be positioned on opposing channel walls of the channels 255 and extend in opposite directions from the channels 255. The anchoring channels 260 share at least a portion of the shared channel wall 257 with the channels 255 and also share at least a portion of the shared channel wall 257 with the channels 210. The shared channel wall configuration of the anchoring channels can allow for a compact arrangement of the structural support components of the vertical end frames 250. The compact arrangement of the vertical end frames 250 may also enable thin wall modules 150.

FIG. 2B illustrates that the width of the anchor channel openings 275 of the anchoring channels 260 is thinner than a width of the of the channel openings 265 of the channels 255. FIG. 2B also illustrates that the width of the anchor channel openings 275 is smaller than the distance between the channel openings 265 of the channels 255 and the first sidewalls 280 of the anchoring channels 260. In this regard, the anchoring channels 260 shown in FIG. 2B can be compact in size while positioned deep enough within the channels 255 to provide support to a pre-fabricated wall system (e.g., pre-fabricated wall system 100) by receiving anchor extensions 480 of a channel insert 475 (see, for example, FIG. 4).

One will appreciate, in view of the present disclosure, that a channel 255 may include any number of anchoring channels 260. For instance, in some examples, a channel 255 includes only a single anchoring channel 260 disposed on one sidewall of the channel 255. In other examples, a channel 255 includes three or more anchoring channels 260 disposed on the sidewalls of the channel 255.

FIG. 2B further illustrates that the channels 255 can include one or more channel protrusions 285 extending from opposing sidewalls of the channels 255. In at least one embodiment, the channel protrusions 285 are configured to align with channel protrusions 285 of an adjacently arranged vertical end frame 250 (e.g., of an adjacently arranged thin wall module 150) and/or with corresponding channel protrusions 485 of a vertical connection post 300 (see, for example, FIGS. 3A-3D). The channel protrusions 285 can include one or more ledges or recesses 290 for interfacing with a connector 410 that secures a thin wall module 150 to an adjacently arranged thin wall module 150 or a vertical connection post 300 (see, for example, FIGS. 4-5).

The channel protrusions 285 may, in some implementations, extend away from the opposing sidewalls of the channels 255 in the same direction as the anchoring channels 260. For example, FIG. 2B illustrates the channel protrusions 285 and the anchoring channels 260 extending orthogonally away from the opposing sidewalls of the channels 255. Those skilled in the art will recognize, in view of the present disclosure, that a channel 255 may include any number of channel protrusions 285 extending therefrom. By way of non-limiting example, a channel 255 can include a single channel protrusion 285 extending from a sidewall of the channel 255 without a channel protrusion 285 on the opposing sidewall.

The thickness of the thin wall module 150, as noted above, is the distance between the opposing outmost faces of the thin wall module 150. In particular, the thickness of the thin wall module 150 is illustrated in FIG. 2A by the distance between opposing outward-facing faces of the ceiling interface component 215 (e.g., the distance between faces 235*a* and 235*b*), the horizontal connection component 205 (e.g., the distance between faces 240*a* and 240*b*), and the floor interface component 225 (e.g., the distance between faces 245*a* and 245*b*). Furthermore, the thickness of the thin wall module 150 is illustrated in FIG. 2B by the distance between opposing outward-facing faces of the vertical end frames 250 (e.g., the distance between faces 293*a* and 293*b*). In some instances, the thickness of the thin wall module 150 is within a range of 1.5 inches to 2.75 inches.

FIG. 2B also shows that the vertical end frames 250 may, in at least one implementation, include secondary channels 295 that can be filled with one or more acoustic fillers 297 to prevent sound and/or air from passing through the vertical end frame 250 at junctions between thin wall modules 150 and other thin wall modules 150 and/or vertical connection posts 300.

Figure 2C:
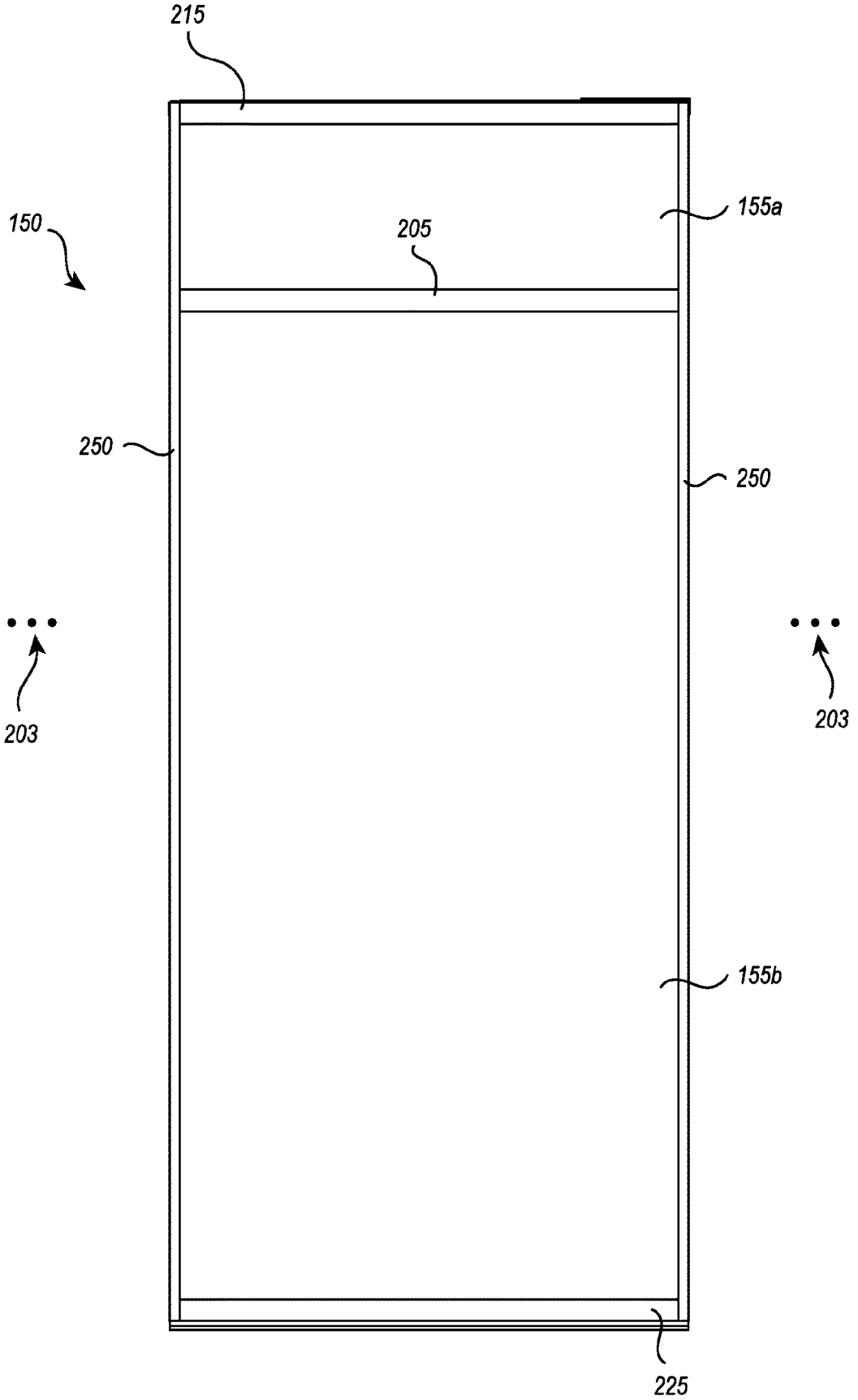
FIG. 2C illustrates a front facing view of a thin wall module and components thereof, in accordance with implementations of the present disclosure.

FIG. 2C illustrates a front facing view of a thin wall module 150. FIG. 2C illustrates that the ceiling interface component 215, the horizontal connection component 205, and the floor interface component 225 can connect to the vertical end frames 250 to form a frame structure for a pre-fabricated thin wall module 150. FIG. 2C also shows that the thin wall tile 155*a* can be surrounded and held in place by frame components (e.g., ceiling interface component 215, the horizontal connection component 205, and the vertical end frames 250). Similarly, FIG. 2C illustrates that thin wall tile 155*b* can be surrounded and held in place by frame components (e.g., floor interface component 225, the horizontal connection component 205, and the vertical end frames 250).

Figure 4:
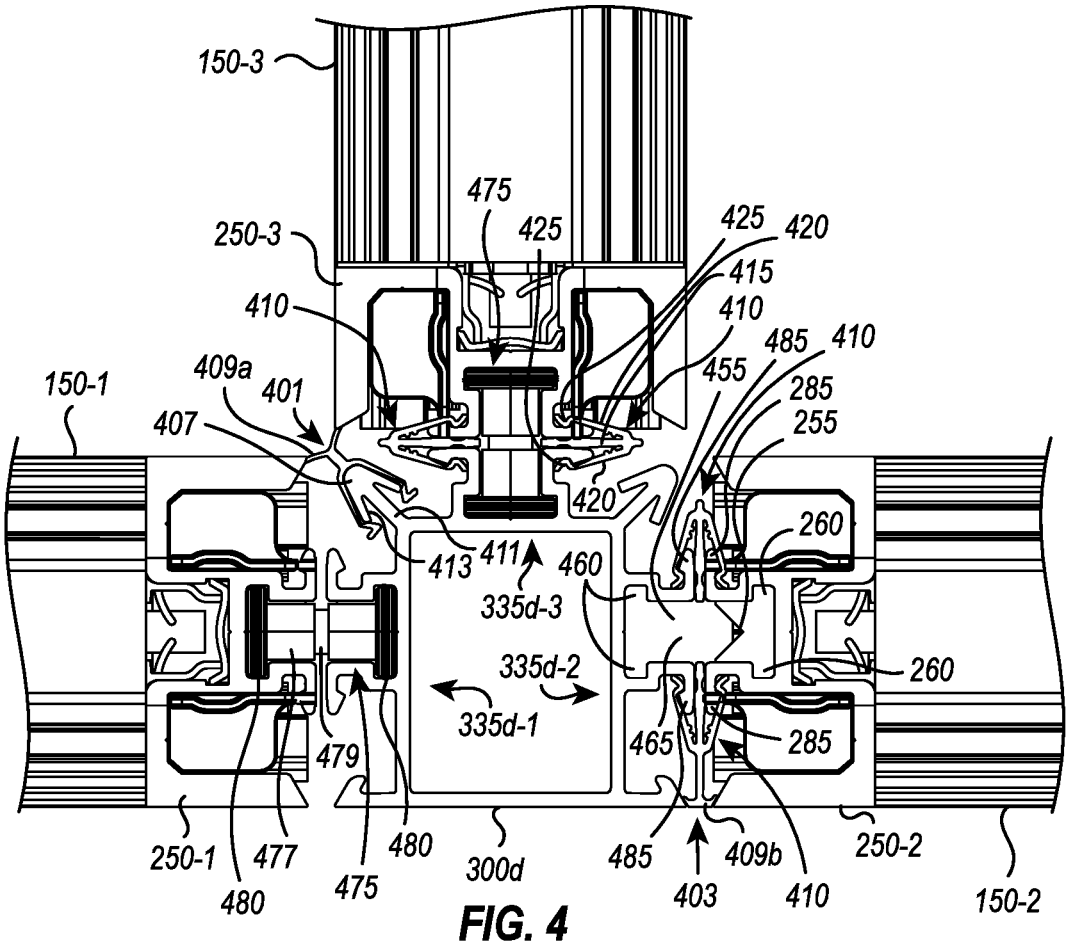
FIG. 4 illustrates a top view of a configuration of three thin wall modules joined together by a vertical connection post in a T-shaped arrangement in a pre-fabricated wall system, in accordance with implementations of the present disclosure.
Figure 5:
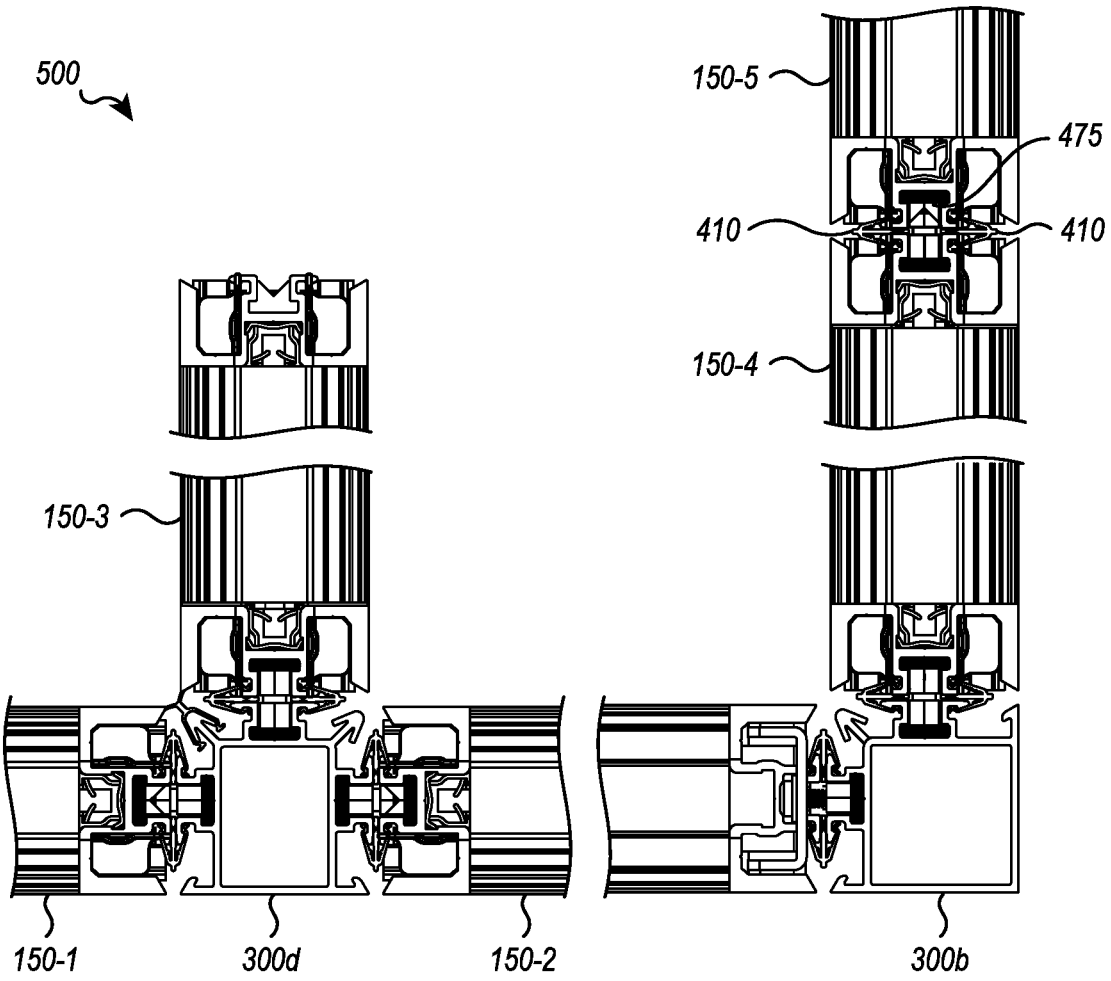
FIG. 5 illustrates a top view of a pre-fabricated wall system including various arrangements of thin wall modules joined together within a pre-fabricated wall system, in accordance with implementations of the present disclosure.

Additionally, FIG. 2C shows ellipses 203, indicating that the vertical end frames 250 of the thin wall module 150 can connect to the vertical end frames 250 of other thin wall frames 150 (see, for example, FIGS. 1 and 5) and/or connect to vertical connection posts 300 (see, e.g., FIGS. 4-5). The vertical connection posts 300 can enable diverse arrangements of thin wall panels 150 within a pre-fabricated wall system (e.g., pre-fabricated wall system 100).

Figure 3A:
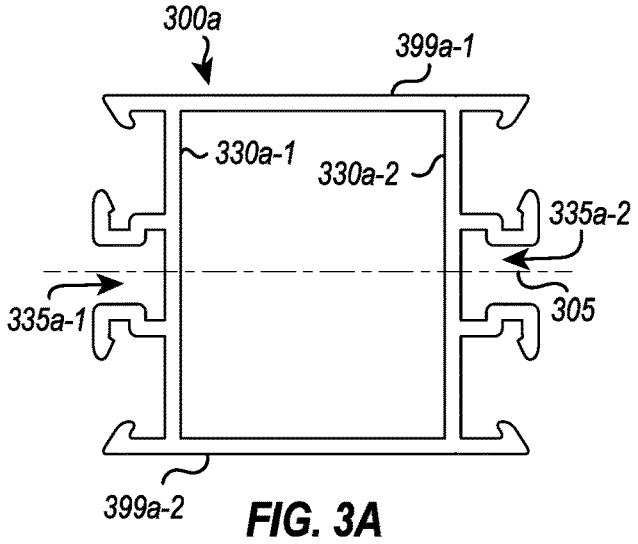
FIG. 3A illustrates a top view of a vertical connection post configured to arrange two thin wall modules parallel to one another in a pre-fabricated wall system, in accordance with implementations of the present disclosure.

FIGS. 3A-3D illustrate top views of various configurations of vertical connection posts 300 for joining thin wall modules in a pre-fabricated wall system. For example, FIG. 3A illustrates that the vertical connection post 300*a* can include at least one side 330*a*-1 that has a connection interface 335*a*-1 that is configured for connecting to a first thin wall module and another side 330*a*-2 that includes a connection interface 335*a*-2 that is configured for connecting to a second thin wall module 150.

In particular, FIG. 3A shows a configuration in which the vertical connection post 300*a* is configured to connect to two thin wall modules such that the thin wall modules become arranged parallel or co-planar to one another when both the thin wall modules are secured to the vertical connection post 300*a*. For instance, FIG. 3A illustrates that a center plane 305 of the vertical connection post 300*a* would align with center planes of thin wall modules when secured to the vertical connection post 300*a*. The center plane 305 can pass through vertical centers of the connection interfaces 335*a*-1, 335*a*-2 of the vertical connection post 300*a* and the vertical end frames (e.g., vertical end frames 250) of the thin wall modules (e.g., thin wall modules 150) that become secured to the vertical connection post 300*a*.

FIG. 3A also demonstrates that outer faces (e.g., faces 293*a*, 293*b*) of different thin wall modules that become secured to the vertical connection post 300*a* can become aligned with one another when both thin wall modules are secured to the vertical connection post 300*a*. The outer faces of the thin wall modules may further align with outer faces 399*a*-1, 399*a*-2 of the vertical connection post 300*a*.

Many of the features and elements of the connection interfaces (e.g., connection interfaces 335*a*-1, 335*a*-2) shown in FIGS. 3A-3B correspond to those shown and described with reference to FIG. 4 (e.g., channels 455, cavity 465, channel insert 475, channel protrusions 485, etc.). Accordingly, FIGS. 3A-3D omit reference to at least some of these features for clarity and/or simplicity.

Figure 3B:
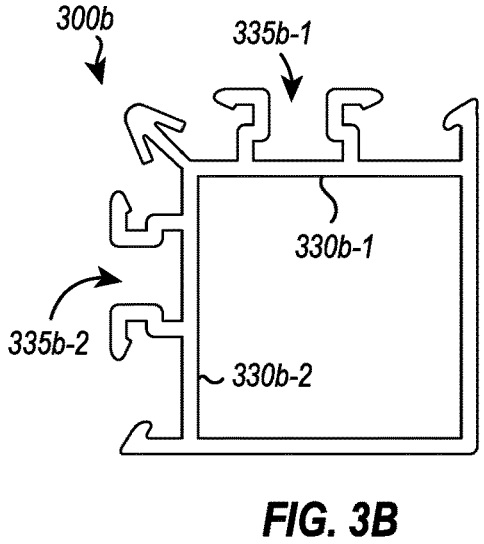
FIG. 3B illustrates a top view of a vertical connection post configured to arrange two thin wall modules perpendicular to one another in a pre-fabricated wall system, in accordance with implementations of the present disclosure.

FIG. 3B illustrates an embodiment of a vertical connection post 300*b* configured for arranging thin wall modules non-parallel to one another when both thin wall modules are secured to the vertical connection post 300*b*. FIG. 3B shows that the connection interface 335*b*-1 for securing to a vertical end frame (e.g., vertical end frame 250) of a thin wall module can be positioned on a side 330*b*-1 of the vertical connection post 300*b* that is orthogonal to the side 330*b*-2 of the vertical connection post 300*b* that includes the connection interface 335*b*-2 for securing to vertical end frame of another thin wall module. In this regard, the thin wall modules form a right angle with respect to one another when both are secured to the vertical connection post 300*b*.

Figure 3C:
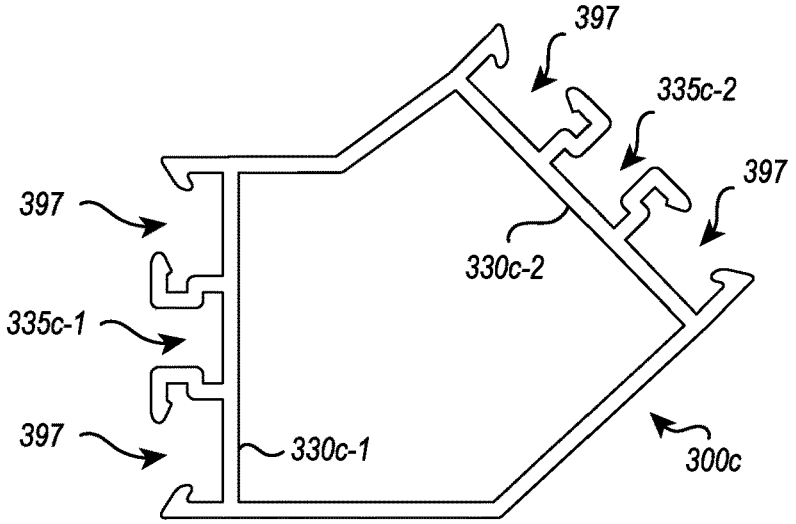
FIG. 3C illustrates a top view of a vertical connection post configured to arrange two thin wall modules non-perpendicular and non-parallel to one another in a pre-fabricated wall system, in accordance with implementations of the present disclosure.

FIG. 3C also illustrates an embodiment of a vertical connection post 300*c* configured for arranging thin wall modules non-parallel to one another when both thin wall modules are secured to the vertical connection post 300*c*. In particular, FIG. 3C shows that the connection interface 335*c*-1 for securing to a vertical end frame of a thin wall module can be positioned on a side 330*c*-1 of the vertical connection post 300*c* that is not orthogonal to the side 330*c*-2 of the vertical connection post 300*d* that includes the connection interface 335*c*-2 for securing to a vertical end frame of another thin wall module. In this regard, the thin wall modules are not perpendicular or parallel to one another when both are secured to the vertical connection post 300*c*.

Accordingly, in view of the present disclosure, those skilled in the art will appreciate that thin wall modules can form any angle with respect to one another when both are secured to a vertical connection post 300. By way of non-limiting example, thin wall modules 150 can form a 30, 45, 60, 75, 90, 105, 120, 135, 150, 165, or 180 degree angle with respect to one another when multiple thin wall modules are attached to a vertical connection post 300.

Figure 3D:
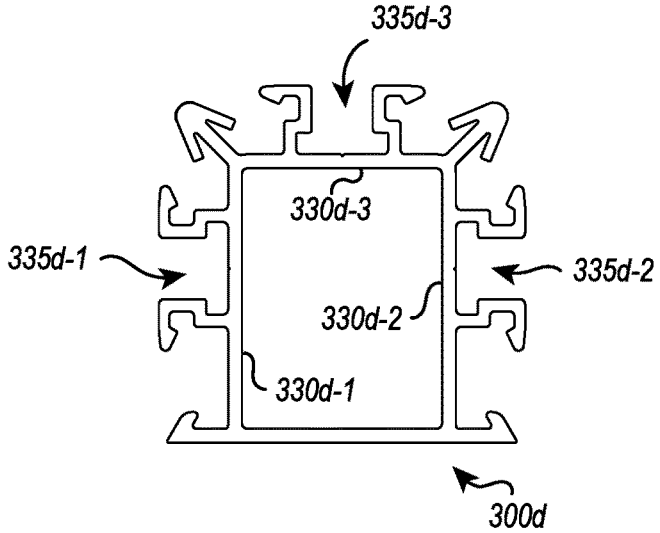
FIG. 3D illustrates a top view of a vertical connection post configured to arrange three thin wall modules in a T-shaped arrangement in a pre-fabricated wall system, in accordance with implementations of the present disclosure.

FIG. 3D illustrates a top view of a configuration of a vertical connection post 300*d* for joining more than two thin wall modules (e.g., thin wall modules 150) for use in a pre-fabricated wall system. FIG. 4A shows an embodiment of a vertical connection post 300*d* that includes connection interfaces 335*d*-1, 335*d*-2, 335*d*-3 disposed on different sides 330*d*-1, 330*d*-2, 330*d*-3 of the vertical connection post 300*d* for securing to vertical end frames of multiple thin wall modules (e.g., via channel inserts 475 and/or connectors 410, see FIG. 4).

FIG. 3D shows that sides 330*d*-1 and 330*d*-2 can be parallel to one another, while side 330*d*-3 can be orthogonal to side 330*d*-1 and side 330*d*-2. Accordingly, a user can affix thin wall modules to attachment interfaces 335*d*-1 and 335*d*-2 to arrange the thin wall modules attached thereto in a parallel or co-planar manner (e.g., similar to the configuration that FIG. 3A illustrates). A user can also affix a thin wall module to attachment interface 335*d*-3 to arrange the thin wall module attached thereto to be perpendicular to the thin wall modules that are secured to attachment interfaces 335*d*-1 and 335*d*-2. Accordingly, a vertical connection post 300*d* can provide a T-shaped interface between three thin wall modules.

Although FIG. 3D illustrates a vertical connection post 300*d* for providing for a T-shaped configuration of thin wall modules 150, one will note that a vertical connection post 300 can provide for an arrangement of thin wall modules 150 in which at least one wall module is not perpendicular or co-planar with at least one other wall module. For example, a vertical connection post 300 can connect to three thin wall modules 150 to form a 120-degree angle between each of the thin wall modules.

Furthermore, those skilled in the art will appreciate, in view of the present disclosure, that a vertical connection post as described herein can accommodate any number of thin wall modules 150. By way of non-limiting example, a vertical connection post 300 can include four connection interfaces for securing thin wall modules. In another example, a vertical connection post can include only a single connection interface for connecting to a single thin wall module.

In addition, those skilled in the art will appreciate, in view of the present disclosure, that the vertical connection posts 300 described herein may comprise any suitable rigid material. In at least one embodiment, the vertical connection posts 300 comprise aluminum, which is strong and can be easily extruded to provide detailed features for attachments (e.g., connection interfaces 335). Furthermore, FIG. 3C demonstrates that the vertical connection posts can include additional channels or openings 397 that can receive an acoustic filler material. In at least one embodiment, the wall thicknesses of the vertical connection post 300 extrusions may be approximately 0.080" (2 mm) thick but may be somewhat thicker or thinner in specific locations or in specific implementations.

FIG. 4 illustrates a top view of a configuration of thin wall modules 150 joined together by a vertical connection post 300*d* for use in a pre-fabricated wall system. FIG. 4 illustrates additional details concerning the connection interfaces 335 (e.g., connection interfaces 335*d*-1, 335*d*-2, and 335*d*-3 of FIGS. 3D and 4) of the vertical connection post 300 (e.g., vertical connection post 300*d* of FIGS. 3D and 4) and the features thereof for connecting to the thin wall modules 150 (e.g., thin wall modules 150-1, 150-2, and 150-3 of FIG. 4).

In particular, FIG. 4 shows that the connection interfaces 335 include a channel 455 that includes anchoring channels 460 and channel protrusions 485. The channel 455, the anchoring channels 460, and the channel protrusions 485 of the connection interfaces 335 can correspond to and/or mirror the channels 255, anchoring channels 260, and channel protrusions 285 of the vertical end frames 250 of the thin wall modules 150. For instance, a user may arrange the vertical end frame 250-2 with the connection interface 335*d*-2 such that the openings of the channels 255, 455 face one another as shown in FIG. 4 to form a cavity 465. The cavity 465 can be composed of the channels 255, 455 and the anchoring channels 260, 460. The channel protrusions 285, 485 extend away from the cavity 465.

With a vertical end frame 250 arranged against a connection interface 335, a user may utilize one or more connection elements to secure the thin wall module 150 to the vertical connection post 300. For instance, FIG. 4 illustrates connectors 410 configured to secure thin wall modules 150 to a vertical connection post 300 by securing the channel protrusions 285 of the vertical end frame 250 to the channel protrusions 485 of the connection interface 335. FIG. 4 shows connectors 410 engaged with channel protrusions 285 and 485 to secure the thin wall modules 150-2 and 150-3 to the vertical connection post 300*d*.

The connector 410, in some instances, includes a body portion 415 that has opposing arms 420 extending therefrom. The opposing arms 420 may include locking members 425 for engaging with the ledges or recesses of the channel protrusions 285, 485. A user may insert the body portion 415 of the connector 410 between the channel protrusions 285, 485 and may advance the locking members 425 of the connector 410 over and into engagement with the ledges or recesses of the channel protrusions 285, 485.

Although FIG. 4 illustrates the connector 410 as forming a substantially U-shaped structure with the body portion 415 extending therebetween, one will recognize that other configurations for the connector 410 are within the scope of this disclosure. For example, the connector 410 may comprise a V-shaped, C-shaped, W-shaped, Y-shaped, T-shaped, E-shaped, or other configuration.

Additionally, or alternatively, the cavity 465 formed by the channels 255, 455 of the vertical end frame 250 and the connection interface 335, respectively, may receive a channel insert 475 configured to reside within the cavity 465. For instance, FIG. 4 shows a channel insert 475 residing within channels 255, 455 of vertical end frames 250-1 and 250-3 to secure thin wall modules 150-1 and 150-3 to the vertical connection post 300*d*.

The channel insert 475 can include an elongated body 477 that extends between the channels 255 and 455 of the vertical end frame 250 and the connection interface 335, respectively. The elongated body 477 can include a recessed portion 479 in a center thereof to accommodate the body portion 415 of connectors 410 when one or more connectors 410 are used in combination with a channel insert 475, as well as to provide a groove for orientation during installation of connectors 310, via interface with installation tools.

The channel insert 475 may also include anchor extensions 480 that are configured to reside within the anchoring channels 260 and 460 of the channels 255 and 455, respectively. The elongated body 477 may extend between the anchor extensions 480 with a length that is greater than the length of the channel openings 265, 270 described herein. The elongated nature of the channel insert 475 may allow the channel insert to extend deep enough into the vertical connection post 300 and the vertical end frames 250 to provide a connection therebetween that can withstand lateral forces applied against a pre-fabricated wall system, as well as maintain panel position relative to one another.

The channel insert 475 may operate to secure the thin wall module 150 (e.g., thin wall modules 150-1 and 150-3) to the vertical connection post 300 (e.g., vertical connection post 300*d*) when a user inserts the channel insert 475 into the cavity 465 formed by the channels 255, 455 with the anchor extensions 480 extending into the anchoring channels 260, 460 of the channels 255, 455.

In some instances, utilizing both channel inserts 475 and connectors 410 to secure a thin wall module 150 to a vertical connection post 300 causes the connection between the thin wall module 150 and the vertical connection post 300 to have strong support against lateral forces that might be applied to the thin wall module 150, as well as sound and airflow seals between sides of the wall, when implemented into a pre-fabricated wall system. For example, FIG. 4 shows thin wall module 150-3 secured to the vertical connection post 300*d* with both connectors 410 and a channel insert 475. The combination of channel inserts 475 and connectors 410 may result in strong support for a pre-fabricated wall system while also allowing for the vertical end frames 250 of the thin wall modules 150 to have a small thickness (e.g., within a range of 1.5 inches to 2.75 inches).

One will appreciate, in view of the present disclosure, that the channel insert 475 can include any number of anchor extensions 480 positioned variously along the elongated body 477 for insertion into any number of corresponding anchoring channels 260, 460 of the vertical end frame 250 and the connection interfaces 335.

FIG. 4 further illustrates that the vertical connection post 300*c* includes a corner protrusion 407 extending toward a space 401 formed between the vertical end frames 250-1 and 250-3 of the thin wall modules 150-1 and 150-3 when both of the thin wall modules 150-1 and 150-3 are secured to the vertical connection post 300*d*. In at least one embodiment, as FIG. 4 illustrates, the corner protrusion 407 can be substantially arrow-shaped, with a body portion 411 and two opposing arms 413 extending therefrom. The corner protrusion 407 can receive a seal 409*a* that has a body portion with locking members extending therefrom that fit and secure over the two opposing arms 413 of the corner protrusion 407. The seal 409*a* can be formed of any suitable material (e.g., an elastic polymer) and can be configured to at least partially fill the space 401 or gap between perpendicular thin wall modules 150 for aesthetic and/or functional purposes (e.g., to prevent air passage and/or to block sound, heat, dust, light, etc.)

FIG. 4 also illustrates a space 403 formed between the vertical end frame 250-2 of the thin wall module 150-2 and the vertical connection post 300*d* when the thin wall module 150-2 is secured to the vertical connection post 300*d*. FIG. 4 further illustrates that a connector 410 may include a seal 409*b* configured for filling the gap or space 403. The seal 409*b*, in at least one implementation (e.g., as FIG. 4 illustrates), can be integrally formed as a part of the connector 410. In other instances, however, the seal 409*b* includes a body portion with a channel extending therefrom for engaging with the body portion 415 of a connector 410.

One will appreciate, in view of the present disclosure, that a user may employ a seal 409*b* to seal a gap or space 403 formed between a thin wall module 150 and a vertical connection post 300. Furthermore, one will appreciate that a user may employ a seal 409*b* to seal any gap or space formed between thin wall modules 150 that are connected to other adjacently arranged thin wall modules 150 (without a vertical connection post 300; see, for example, FIG. 5).

In addition, in one or more implementations of the present disclosure, the seals 409*a*, 409*b* can be medical grade seals. Medical grade seals are those that prevent the flow of air, infectious materials, and/or other contaminants through an assembled pre-fabricated wall system sufficiently to meet hospital standards of cleanliness and/or sterilization. For example, medical grade seals may be used to form a wall system that creates a quarantine space or clean room environment.

The present disclosure shows that thin wall modules can be joined together directly and/or at common vertical connection posts in a variety of configurations to accommodate the desired aesthetics and arrangements for diverse pre-fabricated wall system installation spaces. FIG. 5 illustrates a top view of a portion of a pre-fabricated wall system 500 including various arrangements of thin wall modules 150. For instance, the pre-fabricated wall system 500 includes three thin wall modules 150-1, 150-2, and 150-3 secured to a vertical connection post 300*d* (e.g., as described herein with reference to FIG. 4). The pre-fabricated wall system 500 also shows thin wall modules 150-2 and 150-4 secured to a vertical connection post 300*b* (e.g., as described herein with reference to FIG. 3B).

FIG. 5 shows that the pre-fabricated wall system 500 comprises thin wall module 150-4 joined to another thin wall module 150-5 without a vertical connection post intervening therebetween. The thin wall modules 150-4 and 150-5 can be connected directly to one another via connectors 410 and/or channel inserts 475, as described hereinabove. For example, a user can align the channels 255 and channel protrusions 285 of the vertical end frames 250 of the different thin wall modules 150-4 and 150-5 to face one another. A user can then insert a channel insert 275 into a cavity 265 formed between the aligned channels 255 of the vertical end frames 250 and can advance connectors 410 to engage with the aligned channel protrusions 285 of the vertical end frames 250.

According to the present disclosure, a user of a pre-fabricated wall system can advantageously employ the same connectors 410 and channel insert(s) 475 to secure a thin wall module 150 to another thin wall module 150 and to secure a thin wall module 150 to a vertical connection post 300. Enabling users to utilize common connectors and/or channel inserts to facilitate the connections between adjacently arranged thin wall modules 150 and between thin wall modules and vertical connection posts 300 may simplify the process for installing a pre-fabricated wall system and may reduce manufacturing complexities by reducing the number of different connection elements needed in a pre-fabricated wall system.

Although the foregoing description has focused in some ways on vertical connection posts for joining thin wall modules at vertical interfaces, those skilled in the art will recognize, in view of the present disclosure, that horizontal connection posts can be used to join thin wall modules at horizontal interfaces, and a horizontal connection post can include features similar to those described herein referring to vertical connection posts.

The foregoing description and Figures illustrate features, properties, details, implementations, and variations of pre-fabricated wall systems having thin walls, and components thereof. One will appreciate, in view of the present disclosure, that various embodiments of pre-fabricated wall systems having thin walls, and components thereof, can include any combination of the various features, properties, details, etc. described hereinabove.

In a first embodiment, a pre-fabricated wall system configured for a thin wall module configuration includes two thin wall modules 150, including a first thin wall module and a second thin wall module. The two thin wall modules have a depth defined by a distance from a front surface of each thin wall module 150 to a back surface of each thin wall module 150. The pre-fabricated wall system also includes a vertical connection post 300 that has a first connection interface 335*a*-1 on a first side 330*a*-1 configured to secure to the first thin wall module, the first connection interface 335*a*-1 including a first channel 455, and a second connection interface 335*a*-2 on a second side 330*a*-2 opposite the first side 330*a*-1 configured to secure to the second thin wall module, the second connection interface 335*a*-2 including a second channel 455. The two thin wall modules are parallel or co-planar to one another when the two thin wall modules are secured to the vertical connection post.

The first and second thin wall modules include, respectively, first and second vertical end frames 250 on vertical edges of each of the two thin wall modules 150, and the first and second vertical end frames each include a channel 255. The pre-fabricated wall system also includes first and second channel inserts 475. The first channel insert 475 is configured to reside within the first channel 455 of the first connection interface 335*a*-1 and the channel of the first vertical end frame 250 of the first thin wall module to secure the first thin wall module to the vertical connection post 300, and the second channel insert 475 is configured to reside within the second channel 455 of the second connection interface 335*a*-2 and the channel 255 of the second vertical end frame 250 of the second thin wall module to secure the second thin wall module to the vertical connection post 300.

The channels 255 of the first and second vertical end frames 250 of the first and second thin wall modules 150 have channel protrusions 485 that are configured to align, respectively, with first and second channel protrusions 285 of the first and second channels 255 of the first and second connection interfaces 335*a*-1, 335*a*-2.

The pre-fabricated wall system further includes first and second connectors 410. The first connector 410 is configured to fit over at least a portion of the first channel protrusion 485 and the channel protrusion 285 of the first vertical end frame 250 to secure the first thin wall module to the vertical connection post 300, and the second connector 410 is configured to fit over at least a portion of the second channel protrusion 485 and the channel protrusion 285 of the second vertical end frame 250 to secure the second thin wall module to the vertical connection post 300.

In a second embodiment, the pre-fabricated wall system corresponds to the pre-fabricated wall system of the first embodiment, except that the pre-fabricated wall system does not include channel protrusions or connectors for fitting over the same. Rather, the thin wall modules are secured to the vertical connection post solely by means of the channel inserts.

In a third embodiment, the pre-fabricated wall system corresponds to the pre-fabricated wall system of the first embodiment, except that the pre-fabricated wall system does not include channel inserts and/or channels configured for receiving the same on the vertical end frames and/or the vertical connection post. Rather, the thin wall modules are secured to the vertical connection post solely by means of the connectors secured over corresponding protrusions of the vertical end frames and the connection interfaces of the vertical connection post.

In a fifth embodiment, the pre-fabricated wall system corresponds to the pre-fabricated wall system of the first embodiment, and the first and second connectors further comprise seals configured to fill gaps formed between the first and second thin wall modules and the vertical connection post when the first and second thin wall modules are secured to the vertical connection post.

In a sixth embodiment, the pre-fabricated wall system corresponds to the pre-fabricated wall system of the first embodiment, and the first and second thin wall modules each comprise a wall tile that comprises a solid sheet of material such that no interior cavity is formed within the wall tiles of the first and second thin wall modules.

In a seventh embodiment, the pre-fabricated wall system corresponds to the pre-fabricated wall system of the sixth embodiment, and the two thin wall modules comprise solid glass.

In an eighth embodiment, the pre-fabricated wall system corresponds to the pre-fabricated wall system of the first embodiment, and the first and second thin wall modules are less than four inches thick.

In a ninth embodiment, the pre-fabricated wall system corresponds to the pre-fabricated wall system of the eighth embodiment, and the first and second thin wall modules are between 1.5 inches and 2.75 inches thick.

In a tenth embodiment, the pre-fabricated wall system corresponds to the pre-fabricated wall system of the first embodiment, and the first and second vertical connection components comprise an acoustic filler material extending through additional channels of the first and second vertical end frames.

In an eleventh embodiment, the pre-fabricated wall system corresponds to the pre-fabricated wall system of the first embodiment, except that, rather than the two thin wall modules being arranged parallel or co-planar to one another when the two thin wall modules 150 are secured to the vertical connection post 300, the two thin wall modules become arranged non-parallel to one another when secured to the vertical connection post.

In a twelfth embodiment, the pre-fabricated wall system corresponds to the pre-fabricated wall system of the eleventh embodiment, and two thin wall modules become arranged perpendicular to one another when secured to the vertical connection post, and the vertical connection post comprises a corner protrusion configured to receive a seal for sealing a gap formed between the first and second wall modules when the first and second wall modules are secured to the vertical connection post.

In a thirteenth embodiment, a pre-fabricated wall module 150 configured for a thin pre-fabricated wall configuration includes a pre-fabricated wall tile 155 and a vertical end frame 250 connected to a vertical edge of the pre-fabricated wall tile 155. The vertical end frame 250 includes a first channel 210 configured for receiving the vertical edge of the pre-fabricated wall tile 155 and a second channel 255 disposed opposite the first channel 210. The second channel 255 includes a shared channel wall 257 that is shared between the first channel 210 and the second channel 255, a second channel opening 265 that faces a direction that is opposite to a first channel opening 270 of the first channel 210, channel protrusions 285 extending in opposite directions from the second channel opening 265, and anchoring channels 260 disposed on opposing channel sidewalls of the second channel 255.

The second channel opening is configured to align with a corresponding channel opening of a corresponding vertical end frame of a separate pre-fabricated wall module. When the second channel opening is aligned with the corresponding channel opening, the second channel opening and the corresponding channel opening are configured to receive a channel insert for securing the vertical end frame of the pre-fabricated wall module to the corresponding vertical end frame of the separate pre-fabricated wall module. The channel insert is configured to reside within the second channel, the anchoring channels of the second channel, the corresponding channel, and corresponding anchoring channels of the corresponding channel.

The channel protrusions are configured to align with corresponding channel protrusions of the corresponding vertical end frame. When the channel protrusions are aligned with corresponding channel protrusions, the channel protrusions and the corresponding channel protrusions are configured to engage with connectors for securing the vertical end frame of the pre-fabricated wall module to the corresponding vertical end frame of the separate pre-fabricated wall module.

In a fourteenth embodiment, the pre-fabricated wall module corresponds to the pre-fabricated wall module of the thirteenth embodiment, and a channel width of the anchoring channels is smaller than a distance between the second channel opening and first sidewalls of the anchoring channels.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A pre-fabricated wall system configured for a thin wall module configuration, comprising:

two thin wall modules, including a first thin wall module and a second thin wall module, the two thin wall modules having a depth defined by a distance from a front surface of each thin wall module to a back surface of each thin wall module, wherein the first wall module includes a first vertical end frame that includes a first channel, the first channel comprising, a first channel protrusion, and wherein the second wall module includes a second vertical end frame that includes a second channel, the second channel comprising a second channel protrusion;

a vertical connection post comprising:

a first connection interface on a first side configured to secure to the first thin wall module, the first connection interface including a corresponding first channel that includes a corresponding first channel protrusion; and a second connection interface on a second side opposite the first side configured to secure to the second thin wall module, the second connection interface including a corresponding second channel that includes a corresponding second channel protrusion, wherein the first channel protrusion of the first channel of the first vertical end frame of the first wall module is configured to align with the corresponding first channel protrusion of the corresponding first channel of the first connection interface, and wherein the second channel protrusion of the second channel of the second vertical end frame of the second module is configured to align with the corresponding second channel protrusion of the corresponding second channel of the second connection interface; and first and second connectors, wherein:

the first connector is configured to fit over at least a portion of the first channel protrusion and the corresponding first channel protrusion to secure the first thin wall module to the vertical connection post; and the second connector is configured to fit over at least a portion of the second channel protrusion and the corresponding second channel protrusion to secure the second thin wall module to the vertical connection post;

wherein the two thin wall modules are parallel or co-planar to one another when the two thin wall modules are secured to the vertical connection post.

2. The pre-fabricated wall system of claim 1, wherein the first connection interface is positioned on the first side such that the two thin wall modules are co-planar when the two thin wall modules are secured to the vertical connection post.

3. The pre-fabricated wall system of claim 1, further comprising:

first and second channel inserts, wherein:

the first channel insert is configured to reside within the first channel of the first connection interface and the channel of the first vertical end frame of the first thin wall module to secure the first thin wall module to the vertical connection post; and the second channel insert is configured to reside within the second channel of the second connection interface and the channel of the second vertical end frame of the second thin wall module to secure the second thin wall module to the vertical connection post.

4. The pre-fabricated wall system of claim 1, wherein the first and second connectors comprise seals configured to fill gaps formed between the first and second thin wall modules and the vertical connection post when the first and second thin wall modules are secured to the vertical connection post.

5. The pre-fabricated wall system of claim 1, wherein the first and second thin wall modules each comprise a wall tile that comprises a solid sheet of material such that no interior cavity is formed within the wall tiles of the first and second thin wall modules.

6. The pre-fabricated wall system of claim 1, wherein the first and second thin wall modules are less than four inches thick.

7. The pre-fabricated wall system of claim 1, wherein the first and second thin wall modules are between 1.5 inches and 2.75 inches thick.

8. The pre-fabricated wall system of claim 1, wherein the two thin wall modules comprise solid glass.

9. The pre-fabricated wall system of claim 1, wherein the first and second vertical end frames comprise an acoustic filler material extending through additional channels of the first and second vertical end frames.

10. A pre-fabricated wall system configured for a thin wall module configuration, comprising:

two wall modules, including a first wall module and a second wall module, the first and second wall modules having a depth defined by a distance from a front surface of each wall module to a back surface of each wall module;

a first vertical end frame attached to a vertical edge of the first wall module;

a second vertical end frame attached to a vertical edge of the second wall module; wherein:

each of the first and second vertical end frames includes a channel;

a vertical connection post comprising:

a first connection interface on a first side configured to secure to the first wall module, the first connection interface including a first channel; and a second connection interface on a second side opposite the first side configured to secure to the second wall module, the second connection interface including a second channel; and first and second channel inserts, wherein:

the first channel insert is configured to reside within the first channel of the first connection interface and the channel of the first vertical end frame of the first wall module to secure the first wall module to the vertical connection post; and the second channel insert is configured to reside within the second channel of the second connection interface and the channel of the second vertical end frame of the second wall module to secure the second wall module to the vertical connection post;

wherein the first and second wall modules are arranged non-parallel to one another when the first and second wall modules are secured to the vertical connection post.

11. The pre-fabricated wall system of claim 10, wherein the first and second wall modules form a right angle when both are secured to the vertical connection post.

12. The pre-fabricated wall system of claim 10, wherein the vertical connection post comprises a corner protrusion configured to receive a seal for sealing a gap formed between the first and second wall modules when the first and second wall modules are secured to the vertical connection post.

13. The pre-fabricated wall system of claim 10, wherein:

the first and second wall modules each comprise a wall tile that comprises a solid sheet of material that is less than one inch thick, such that no interior cavity is formed within the wall tiles of the first and second wall modules; and the first and second vertical end frames of the first and second wall modules are less than three inches thick.

14. A pre-fabricated wall module for use in the pre-fabricated wall system as recited in claim 10, the pre-fabricated wall module configured for a thin pre-fabricated wall configuration, comprising:

a pre-fabricated wall tile; and a third vertical end frame connected to a vertical edge of the pre-fabricated wall tile, the third vertical end frame comprising:

a first channel configured for receiving the vertical edge of the pre-fabricated wall tile; and a second channel disposed opposite the first channel, comprising:

a shared channel wall that is shared between the first channel and the second channel;

a second channel opening that faces a direction that is opposite to a first channel opening of the first channel;

channel protrusions extending in opposite directions from the second channel opening; and anchoring channels disposed on opposing channel sidewalls of the second channel.

15. The pre-fabricated wall module of claim 14, wherein:

the second channel opening is configured to align with a corresponding channel opening of a corresponding other vertical end frame of a separate pre-fabricated wall module;

wherein when the second channel opening is aligned with the corresponding channel opening:

the second channel opening and the corresponding channel opening are configured to receive a channel insert for securing the third vertical end frame of the pre-fabricated wall module to the corresponding other vertical end frame of the separate pre-fabricated wall module, the channel insert being configured to reside within:

the second channel;

the anchoring channels of the second channel;

the corresponding channel; and corresponding anchoring channels of the corresponding channel.

16. The pre-fabricated wall module of claim 15, wherein:

the channel protrusions are configured to align with corresponding channel protrusions of the corresponding other vertical end frame;

wherein when the channel protrusions are aligned with corresponding channel protrusions:

the channel protrusions and the corresponding channel protrusions are configured to engage with connectors for securing the vertical end frame of the pre-fabricated wall module to the corresponding vertical end frame of the separate pre-fabricated wall module.

17. The pre-fabricated wall module of claim 14, wherein a channel width of the anchoring channels is smaller than a distance between the second channel opening and first sidewalls of the anchoring channels.

* * * * *